US007631640B2

(12) United States Patent
Hofbauer et al.

(10) Patent No.: US 7,631,640 B2
(45) Date of Patent: Dec. 15, 2009

(54) RADIANT BURNER

(75) Inventors: Peter Hofbauer, West Bloomfield, MI (US); Yue Xin Huang, Goleta, CA (US)

(73) Assignee: Advanced Propulsion Technologies, Inc., Goleta, GA (US)

( * ) Notice: Subject to any disclaimer, the term of this patent is extended or adjusted under 35 U.S.C. 154(b) by 0 days.

(21) Appl. No.: 11/631,436

(22) PCT Filed: Jun. 28, 2005

(86) PCT No.: PCT/US2005/022657

§ 371 (c)(1),
(2), (4) Date: Aug. 8, 2007

(87) PCT Pub. No.: WO2006/017003

PCT Pub. Date: Feb. 16, 2006

(65) Prior Publication Data

US 2007/0269758 A1 Nov. 22, 2007

Related U.S. Application Data

(60) Provisional application No. 60/585,900, filed on Jul. 7, 2004, provisional application No. 60/621,179, filed on Oct. 23, 2004.

(51) Int. Cl.
*F23D 14/14* (2006.01)
*F23D 14/18* (2006.01)

(52) U.S. Cl. ..... 126/39 R; 431/328; 431/329; 431/100; 431/103; 431/242; 431/243; 362/179; 126/99 R

(58) Field of Classification Search ..... 431/326, 431/328, 329, 100–113, 242, 243; 362/159, 362/179; 126/99 R, 85 R, 92 B, 93, 97, 39 R
See application file for complete search history.

(56) References Cited

U.S. PATENT DOCUMENTS

| | | | | | |
|---|---|---|---|---|---|
| 953,096 | A | * | 3/1910 | Lundgren | 362/179 |
| 1,473,844 | A | * | 11/1923 | Garbarini | 126/96 |
| 3,140,740 | A | * | 7/1964 | Lagreid et al. | 126/6 |
| 3,179,156 | A | * | 4/1965 | Weiss et al. | 431/329 |
| 3,202,205 | A | * | 8/1965 | Webster | 48/180.1 |
| 3,204,683 | A | * | 9/1965 | Ruff et al. | 431/249 |
| 3,208,247 | A | * | 9/1965 | Weil et al. | 431/328 |
| 3,360,028 | A | * | 12/1967 | Saponara et al. | 431/329 |
| 3,684,260 | A | * | 8/1972 | Solbrig | 432/31 |
| 4,452,225 | A | * | 6/1984 | Plant | 126/92 B |
| 4,569,329 | A | * | 2/1986 | Cherryholmes | 126/92 B |
| 4,584,426 | A | * | 4/1986 | Nelson | 136/253 |

(Continued)

*Primary Examiner*—Carl D Price
(74) *Attorney, Agent, or Firm*—Paul K. Godwin, P.C.

(57) ABSTRACT

A highly efficient radiant burner assembly (100) for use in a patio heater or the like in areas where people prefer or require low NOX emissions. The efficiencies are created through the use of a spherical burner element (116) that is either formed of a high temperature steel wire mesh or stamping containing apertures of a predetermined size to allow combustion to remain within the burner element and to not cause the temperature of the burner element to exceed the temperature at which NOX are developed. Coating the burner with a catalyst also aids the low emission combustion process. Additional efficiencies are provided by atomizing the fuel before it is mixed with air and by the use of a laminar flow heat exchanger (940) that utilizes a fluid media flowing in a helical coil condenser unit.

21 Claims, 15 Drawing Sheets

U.S. PATENT DOCUMENTS 4,723,513 A * 2/1988 Vallett et al. ..... 122/18.4
5,016,611 A * 5/1991 Lai ..... 126/258
5,060,629 A * 10/1991 Sirand ..... 126/92 B
5,474,443 A * 12/1995 Viessmann et al. ..... 431/329
5,645,043 A * 7/1997 Long et al. ..... 126/92 AC
5,931,660 A * 8/1999 Amrhein et al. ..... 431/328
6,092,912 A * 7/2000 Nelson ..... 362/253
6,202,640 B1 * 3/2001 Naperola et al. ..... 126/41 R
6,213,757 B1 * 4/2001 Kushch et al. ..... 431/7
6,612,834 B2 * 9/2003 Sirand ..... 431/329
6,742,814 B2 * 6/2004 Resmo et al. ..... 285/272
7,177,535 B2 * 2/2007 Pellizzari et al. ..... 392/478
7,313,916 B2 * 1/2008 Pellizzari ..... 60/520

* cited by examiner

RADIANT BURNER

BACKGROUND

1. Field of the Invention

The invention relates to the field of radiant burner systems for providing radiant heat energy through efficient combustion of a gaseous fuel/air mixture. More specifically the invention relates to the area of burner assembly and heat exchanger configurations for use in patio heaters, room heaters and space heaters, as well as other products that require efficient sources of radiant heat energy. Additional efficiencies are provided by utilizing heat exchangers to extract otherwise wasted heat from exhaust gas.

2. Description of the Prior Art

Radiant heaters are known which use various configurations of wire mesh or perforated sheet metal burner elements to support combustion of a gaseous fuel/air mixture. The use of perforated sheet metal of the same configurations is also known to provide an even distribution of gases from the gas inlet port to the inner surface of the burner element. Some of these concepts are described in U.S. Pat. No. 5,474,443. However in the patent, the burner surface and distributors are each limited to a hemispherical shape for use in boilers,

SUMMARY OF THE INVENTION

The present invention utilizes a heavy fuel and gas burner element having a substantially spherical shape to provide a radiant heat source with improved efficiency. The outer burner element is constructed of woven high temperature rated metal wires of sufficient diameter to withstand the heat of combustion occurring at its surface and small enough to result in mesh having a predetermined porosity that allows the micro-mist or gaseous fuel/air mixture to escape therethrough.

The invention further includes a diffuser element that is also substantially spherical in shape but smaller in diameter than the burner element so as to be concentric with and substantially equally spaced from the burner element. The diffuser element is constructed from perforated sheet metal to allow the even flow of the micro-mist or gaseous fuel/air mixture to the space between the diffuser and the burner element. A micro-mist or gas flow inlet tube delivers the fuel/air mixture to the inside of the diffuser element to propagation through to the burner element. A circular distribution disk of sheet metal or other high temperature material that is not distorted or consumed by the temperatures within the burner element, is mounted in front of the inlet tube opening and inside the diffuser element to uniformly disperse the fuel/air mixture inside the diffuser element. In another embodiment the distributor element is a perforated metal cylinder or cone mounted at the end of the inlet tube.

The invention also includes an embodiment with a heat exchanger located in the path of exhaust gasses in order to extract additional heat for auxiliary uses.

When first ignited, combustion initially occurs with a visible flame on or just external to the surface of the burner element. However, as the combustion heats the surface of the burner element, the flame disappears and combustion moves to the surface. This allows the burner element to act as a pure heat energy radiator. The spherical shape of the burner element and associated diffuser element provide a relatively large radiation surface for the overall size of the assembly. By maintaining a lean mixture, the result is a relatively cool "flameless" combustion that maintains the burner element in the range of approximately 800-1000° C. In this mode, the burner results in a substantially emission free combustion of less than 10 ppm of nitrogen oxides (NOx) w/o catalytic coating and less than 2 ppm with catalytic coating. This unique thermal process also produces very high thermal energy. The combustion is quenched, or captivated, to the surface of the burner. The actual heat is produced by radiation from the burner surface. Heat radiation is a significant factor in heat transfer, especially when the temperature is high. In this case, the burner produces radiant heat efficiently with a combustion gas temperature lower than 1300° C. w/o catalytic coating and less than 1100° C. with catalytic coating. This is in contrast to conventional burners, which produce large quantities of thermal NOx when a gas-fired combustion exceeds 1538° C. (2800° F.).

The radiant burner of the present invention is shown in various environments including patio heaters which provide for unique configurations as compared with conventional heaters with central posts. This invention also can be used to generate heat energy for applications such as space heaters, wall furnaces, room heaters, garage heaters, fireplace heaters, "visual flame" type heaters and floor devices for homes, offices and recreational vehicles where high efficiency and low NOx emissions are desired.

In a further embodiment, a high efficiency laminar flow heat exchanger is located in the path of combustion gas as it is exhausted from the burner element. A liquid medium is employed in the heat exchanger to assist in the transfer of heat from the exhaust gas. The extracted heat can be provided for auxiliary storage or immediate uses. The combustion gas is condensed by the heat exchanger and the condensation is drained off.

In combination with a properly designed reflector, the energy is directed in a predetermined heat radiation pattern, so as to provide an even distribution pattern, preferably without hot spots.

In summary, the flameless surface combustion is optimized to burn below the temperature where NOx is produced, but still combusts at an optimized range that takes advantage of producing efficient radiant heat, resulting in a small, highly efficient, and emission free heavy fuel or gas-fired burner.

It is therefore an object of the present invention to provide a radiant burner assembly comprising a generally spherical shaped burner element having a first opening that surrounds the opening of a fuel/air delivery tube to allow for a fuel/air mixture to be delivered within said element; wherein said burner element is formed of material that has an array of apertures of a predetermined size and spacing over substantially its entire spherical surface and remains undeformed at all temperatures within the range of use.

It is a further object of the present invention to provide a radiant burner which is usable in a patio heater and other heat radiating devices in which low NOx emissions are desired.

DETAILED DESCRIPTION OF THE INVENTION

Figure 1:
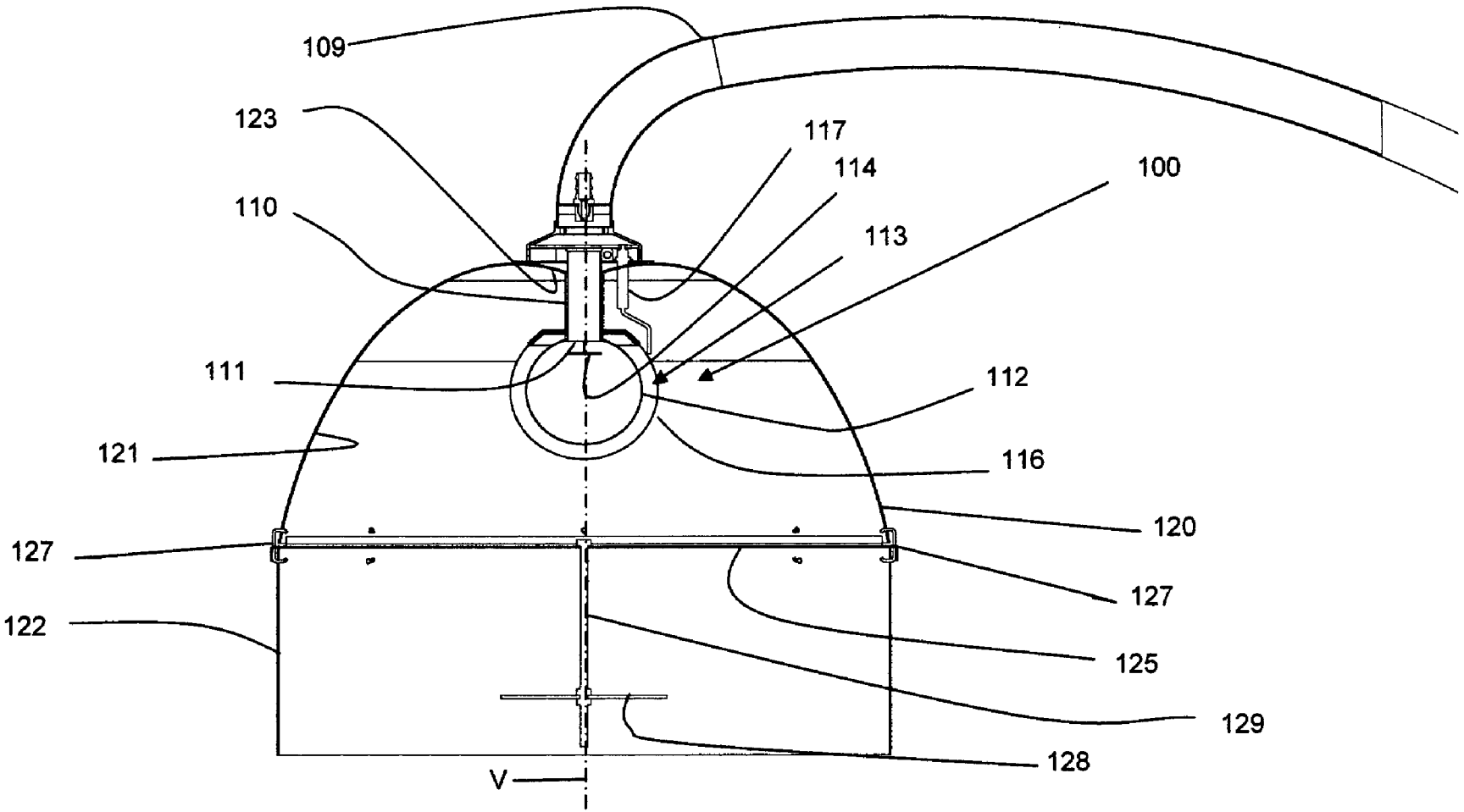
FIG. 1 is a cross-sectional plan view of the preferred embodiment of the radiant burner assembly of the present invention configured for use in a patio heater.

In FIG. 1, the preferred embodiment of the radiant burner assembly 100 of the present invention is shown in cross-section and configured in a patio heater. The parts of the assembly include a gas feed tube 110, a diffuser element 112, a distribution disk 114, a burner element 116 and a reflector element 120. As can be seen from FIG. 1, the diffuser element 112 and the burner element 116 are substantially spherical in shape and differently sized so as to define a substantially spherical space 113 between them. The distance between the diffuser element 112 and the burner element 116 is substantially less than the diameter of the diffuser element 112.

The gas feed tube 110 is connected to an extension arm 109 that serves to provide mechanical support and deliver the fuel and air mixture or a micro-mist from a pressurized source to the burner assembly. The gas feed tube 110 in turn provides a support structure for other elements of the burner assembly and a delivery path for the mixture of a gaseous fuel/air delivered to the burner. The distribution disk 114 is attached to the gas feed tube 110 and is spaced from the opening 111 to provide a uniform diversion of the fuel/air mixture as it enters the burner assembly. The distribution disk 114 is formed from sheet metal, a ceramic or another heat tolerant material and is mounted below the opening 111 of the gas feed tube 110 (in this case, approximately 1 inch) in order to evenly distribute the gaseous fuel/air mixture over the internal surface of the diffuser element 112. Since the burner assembly is substantially spherical in shape, the distribution disk 114 is of circular configuration. However, it is contemplated that three dimensional elements may be substituted for distribution. These may have conical or other truncated shapes to provide the needed uniform distribution of the fuel/air mixture to the burner.

The diffuser element 112 is formed of perforated sheet metal to have a substantially spherical shape attached to the gas feed tube 110 and having a small opening that surrounds the end of the gas feed tube 110 and the opening 111. The perforations in the sheet metal of the distributor element 112 are evenly spaced over the surface area of the sheet metal in order to allow an even distribution of the gaseous fuel/air mixture to the spherical zone 113 adjacent the inside surface of the burner element 116. The burner element 116 is also substantially spherical in shape, as well as concentric with and larger than the diffuser element 112. The burner element 116 is attached to the gas feed tube 110 for rigid support, having a relatively small opening that surrounds the opening 111 to allow entry of the gas feed tube 110 into the interior of its defined sphere. In this embodiment, the burner element 116 is formed of a high temperature steel wire mesh. As an option to provide further reduction in NOX during combustion, the mesh may be subjected to an aluminum oxide wash coat and then a catalyst coating of palladium or the like during its formation process.

The reflector element 120 is preferably formed of a rigid and lightweight material, such as aluminum or other metal having the desired reflective properties. Alternatively an insulated structure can be used and onto which an appropriate reflective coating can be placed on its inner surface 121. In either event, the reflector element 120 provides a controlled pattern of heat radiation to the area below the burner assembly. In this embodiment, the reflector 120 is shown to be formed of a single unit, having a central opening 123 which is attached to the extension arm 109 for rigid support. In the shown embodiment, a cylindrical protective extension member 122 is attached to the major opening 125 of the reflector 120. A plurality of clips 127 are used to hang the protective extension member 122 from the reflector 120 in a manner that provides limited exposure to direct radiation of heat from the burner 116. In addition, the extension carries a light baffle 128 on a support member 129 that serves to block direct radiation and avoid a central hot spot. The protective extension member 122 may be formed of a metal having a reflective inner surface or glass with or without a partially reflective coating to allow the soft glow to be transmitted while controlling the reflective pattern of the radiated heat energy. The goal of distributing heat from the burner assembly in this patio heater embodiment is to define a circular pattern in a plane that is perpendicular to the central vertical axis "V" of the reflector. Therefore the reflector is designed so as to flood the area of the pattern closest to the axis with reflected heat while direct radiation is blocked by the baffle 128. The intermediate area defined beyond the blocked area is flooded with both direct and reflected radiation, while the defined outer area receives only reflected radiation. In the event that it is desired to define a distribution pattern that is rectangular or non-circular, or one that provides an uneven distribution, it is certainly conceivable that one could design a reflector using know principles to accomplish such desires.

Figure 2A:
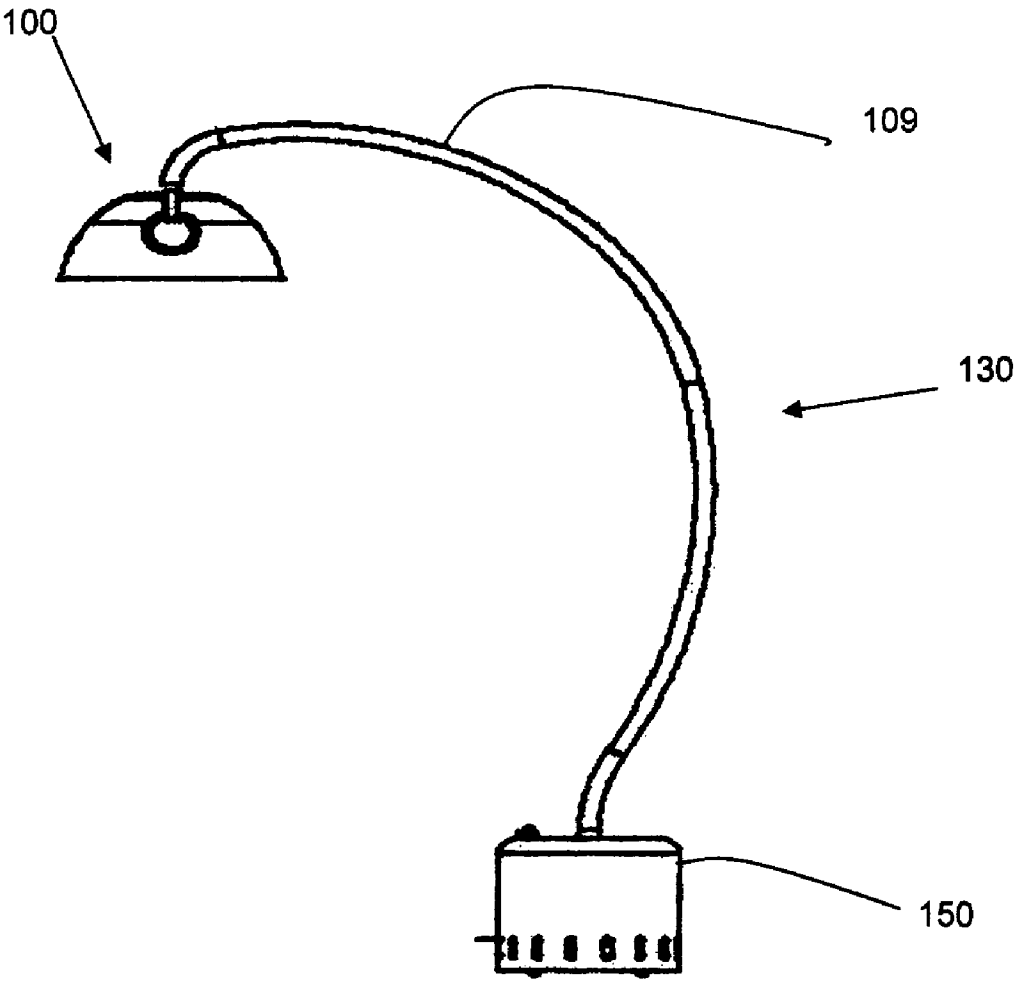
FIG. 2A is a plan view of a patio heater containing the radiant burner of the present invention.

In FIG. 2A, the burner assembly 100 described with respect to FIG. 1 is shown embodied in a patio heater 130. The extension arm 109 is shown as extending from a base unit 150 where the fuel may be stored and the control system located. The mixing of the gas from the fuel supply with air occurs in the gas feed tube 110 within the burner assembly. In the alternative, the fuel is supplied along a separate tube or capillary within the tube 100 and is emitted into the burner assembly as an atomized micro-mist of the fuel where it is mixed with air. In order to provide the actual burner assembly 100 at a location where it will supply an uninterrupted area of heat distribution, such as over a table where people may be seated or standing, the extension arm 109 extends upwards from the base 150 in an arc to a desired height and projects radially to a desired distance. Of course the base must have a great enough mass to serve as a counterweight to the extended arm 109 and the burner assembly 100.

Figure 2B:
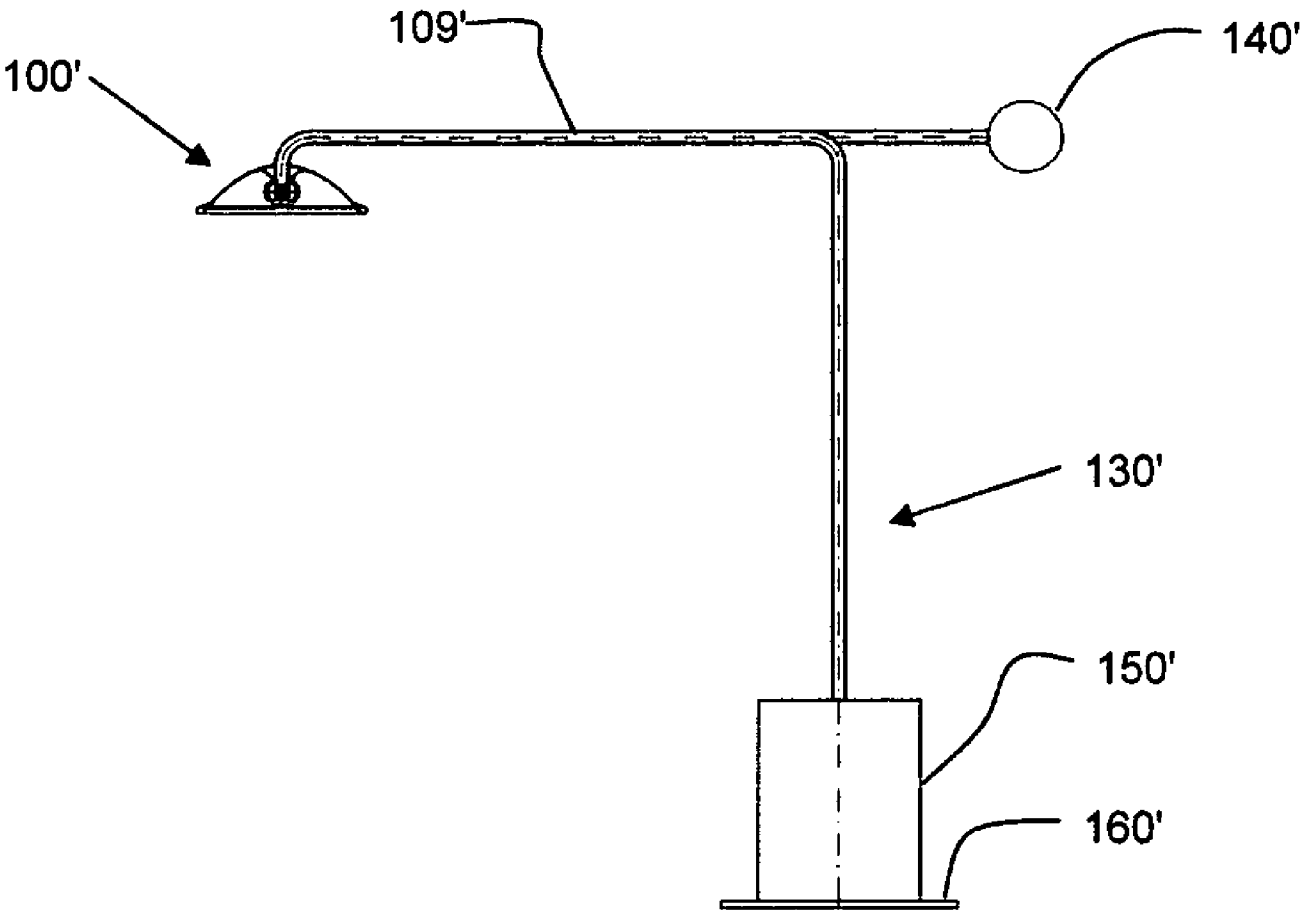
FIG. 2B is a plan view of another patio heater containing the radiant burner of the present invention.

In FIG. 2B, the burner assembly is designated as 100' and is in another configuration of a patio heater 130'. In this embodiment a horizontal extension arm 109' and counterweight 140' are supported above a base 150'. In an alternative configuration (not shown) a suspended array of burner assemblies with reflectors are possible alternatives to the patio heaters shown in FIGS. 2A and 2B.

Figure 3B:
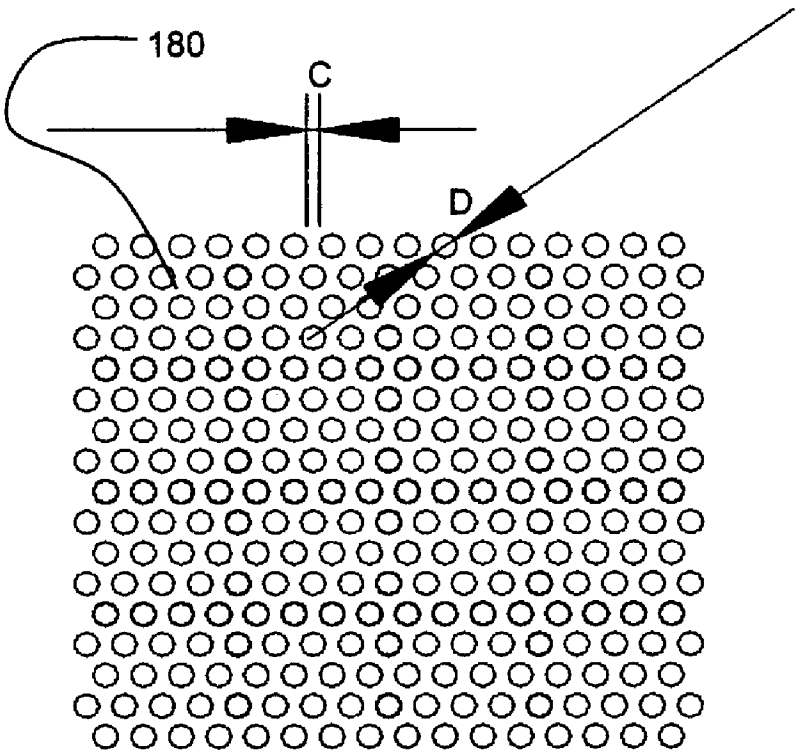
FIG. 3B shows a detailed area of a perforated metal embodiment of the burner element surface.
Figure 3A:
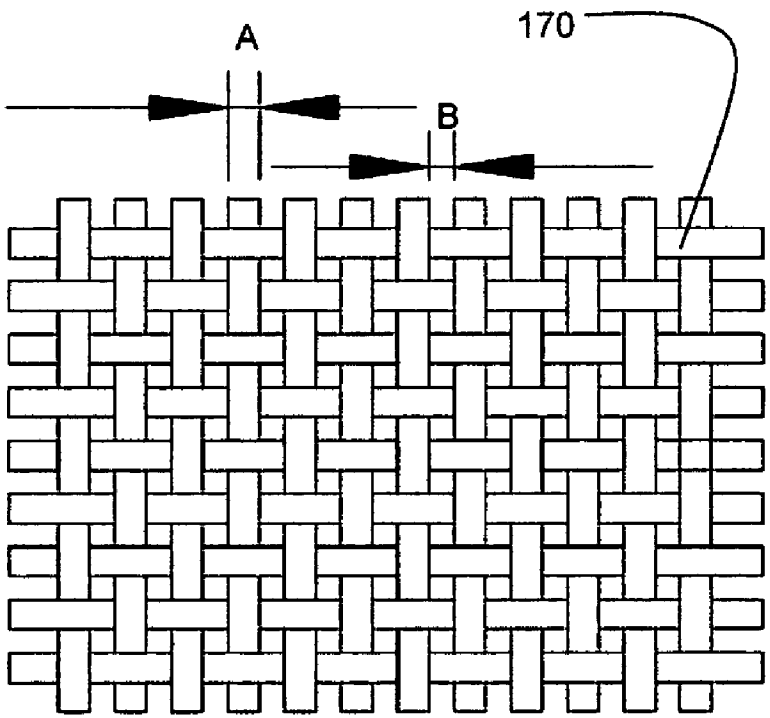
FIG. 3A shows a detailed area of a wire mesh embodiment of the burner element surface.

The burner element 116 shown in FIG. 1 is preferably formed from a woven mesh 170 and is shown in FIG. 3A. The mesh is formed from the highly compact weaving of high temperature steel wire having a thickness "A" of approximately 1 mm so as to provide a spacing gap "B" of no more than 0.8 mm. The spacing gap "B" is critical to keeping the combustion of the gaseous fuel/air mixture within the fairly low temperature range of between 900-1100° C. and thereby keeping the burner element below 1600° C. and maintaining the low NOX characteristics of the invention.

Backfiring in the burner has been found to be prevented when the gaps are held to less than 0.8 mm.

In FIG. 3B an alternative material is shown that can be used for the burner element 116. A sheet metal stamping 180 is shown that contains a continuous array of spaced apart apertures having openings "D" sized to no more than 0.8 mm and being evenly spaced apart "C" by 0.4 mm.

Either of the materials shown in FIGS. 3A and 3B may be formed into a substantially spherical shape to form the burner element 116. However, in order to maintain an efficient combustion over the surface of the burner element 116 and resultant low NOX emissions, it is necessary that the 0.8 mm openings not become distorted and altered as the burner element is heated to its operating temperature.

It is expected that other materials may be substituted for those suggested here for the various elements. While the inventors have found that those described here are adequate and perform well, other materials such as porous ceramics or high temperature tolerant materials may perform equally as well.

The flexible wire mesh 170 shown in FIG. 3A is preferred to avoid heat stresses in the reaction zone of the burner element 116.

Figure 4B:
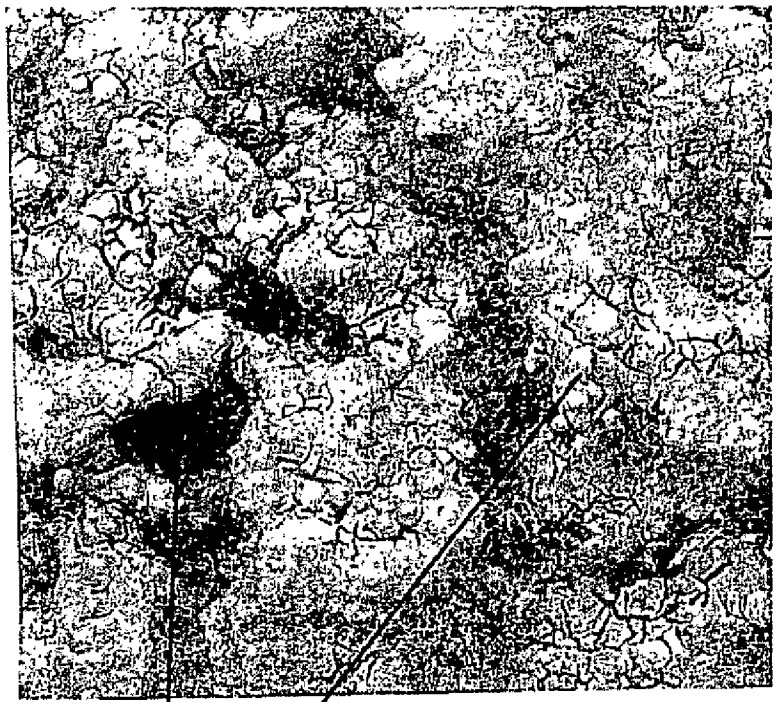
FIG. 4B is a 500/1 micrograph of the burner element surface embodiment of FIG. 3A.
Figure 4A:
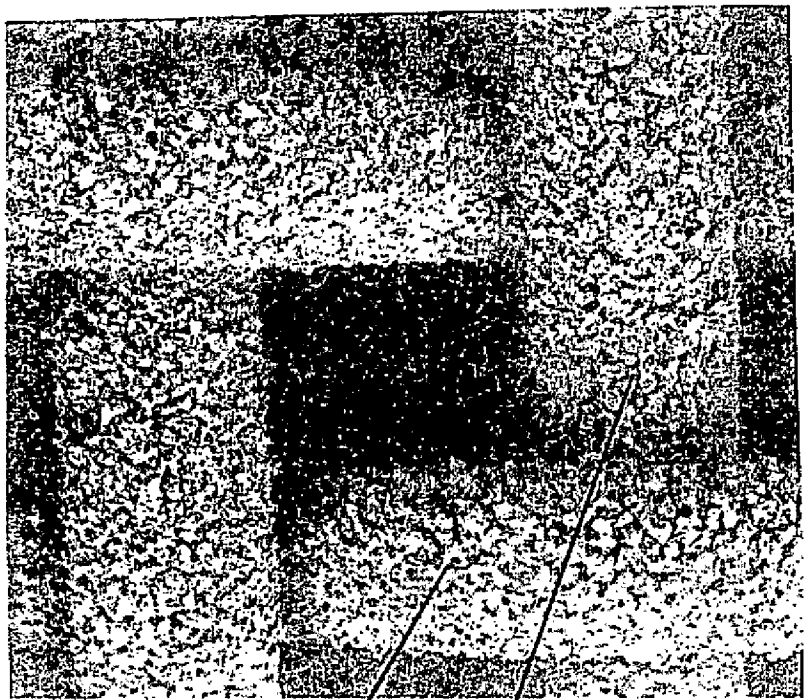
FIG. 4A is a 50/1 micrograph of the burner element surface embodiment of FIG. 3A.

If a catalyst is used, the diameter of the wires has to be as large as possible to be able to provide a wash-coat (aluminum-oxide: $AL_2O_3$) on the wires. With reference to the micrograph in FIG. 4A, a rough whiskered surface 171 is created by heat treating the wires 170 (from the Al content in the steel). The wash-coat adheres to this surface. The wash-coat carries the catalyst which is preferably Palladium to support lean methane combustion. The purpose of providing the rough whiskered surface 171 on the wires 170 is to increase the surface area onto which the catalyst is applied and exposed to the combustion/oxidation of the gas. In FIG. 4B, the palladium catalyst is shown as globules 172 attached to the $Al_2O_3$.

Figure 5B:
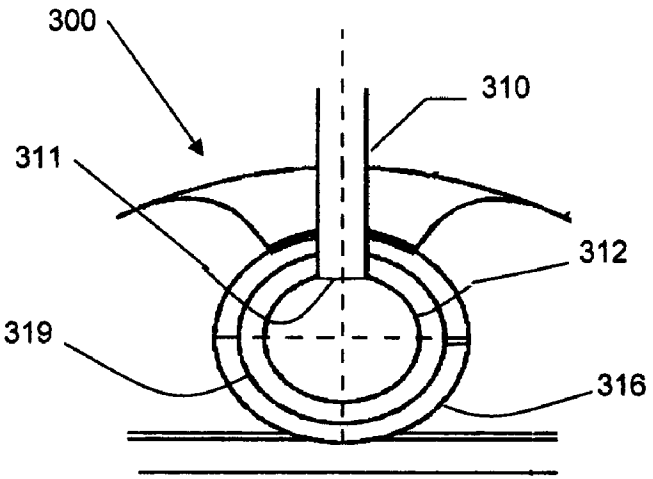
FIGS. 5A and 5B are cross-sectional plan views of other embodiments of the invention.
Figure 5A:
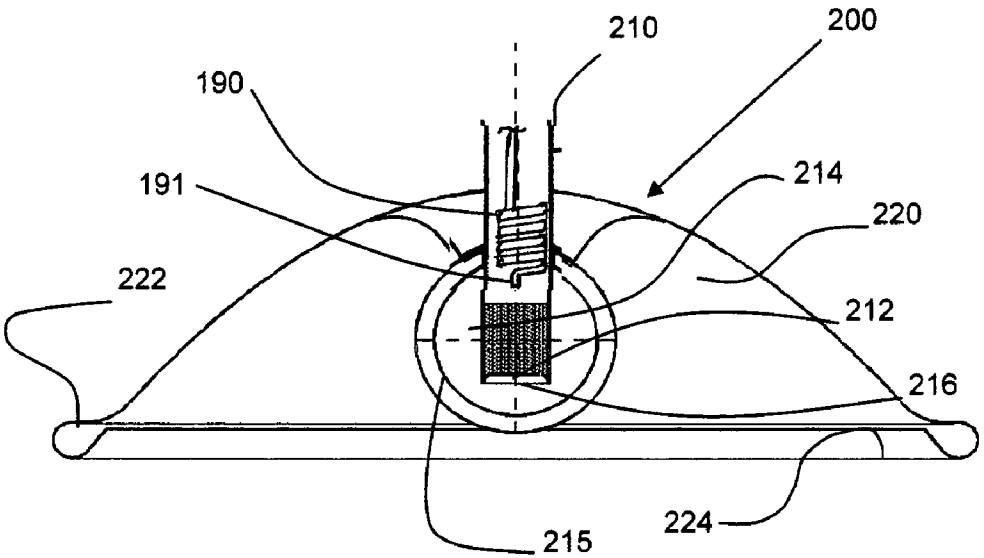

In FIG. 5A, a burner assembly 200 is shown as an alternative embodiment of the invention. In this embodiment, the distributor element 214 is formed as a right cylinder having a closed end that is attached to and extends from the opening of the gas feed tube 210. The distributor element 214 is formed of perforated sheet metal with an even distribution of apertures on its curved cylindrical surface with its end closed with a disk piece 215. The distributor element 214 provides an acceptable uniform distribution of the gaseous fuel/air mixture. The spherical burner element 216 is substantially the same as that shown in FIG. 1, as is the diffuser element 212. In this embodiment, a reflector 220 is shown in which an outer lip 222 is formed at its periphery to define a gutter 224 that extends just below the maximum extension of the inner surface 221. The gutter 224 acts to collect any condensation that may initially form on the inner surface 221 during start up of the burner and prevent the condensation from dripping from the burner assembly 200. After initial ignition when the burner has stabilized its combustion, condensation is no longer a concern and the condensation collected in the gutter 224 evaporates.

FIG. 5A further shows the location of a capillary tube 190 within the gas feed tube 210 to provide atomized fuel as a micro-mist. In a conventional manner, liquid fuel within the capillary is heated to near its boiling point. In this embodiment, the heating may be performed by either an auxiliary electrical source applied to the capillary, an adjacent heating element and/or by the excess heat generated by the burner assembly after start up. Under pressure, the fuel flows through the capillary and exits the open end of the capillary 191 as an atomized micro-mist. The micro-mist of fuel then mixes with the air flowing through the gas feed tube 210 and enters the burner assembly via the distributor element 214. Upon entry into the burner assembly, the fuel/air mixture migrates to the burner element and combustion takes place. With this alternative fuel delivery technique, the burner can be made to provide complete combustion of heavy fuels as well as gas fuels. It is expected that the use of the micro-mist injection technique can be used with any of the distributor configurations shown or described herein as well as others yet to be created.

In still another embodiment shown in FIG. 5B, a burner assembly 300 corresponds to the burner assembly shown in FIG. 1. However, in this embodiment, a baffle element 319 is added. The substantially spherical baffle element 319 is formed of perforated sheet metal similar to the distributor element 312 and, like the distributor element 312, has evenly distributed perforations to allow the gaseous fuel/air mixture to pass towards the burner element 316. The baffle element 319 is also attached to the gas feed tube 310 for rigid support.

The function of the baffle element 319 is to allow uniformly constant migration of the fuel/air mixture from the diffuser element 312 to the burner element 316 and to reduce noise that is generated by the combustion of the gaseous fuel/air mixture occurring at the surface of the burner element 316. The baffle element 319 is formed to be larger than the diffuser element 312 and smaller than the concentric burner element 316. In this manner, substantially spherical zones 313 of predetermined thicknesses are defined between the diffuser element 312 and baffle element 319, and between the baffle element 319 and the burner element 316.

Figure 6:
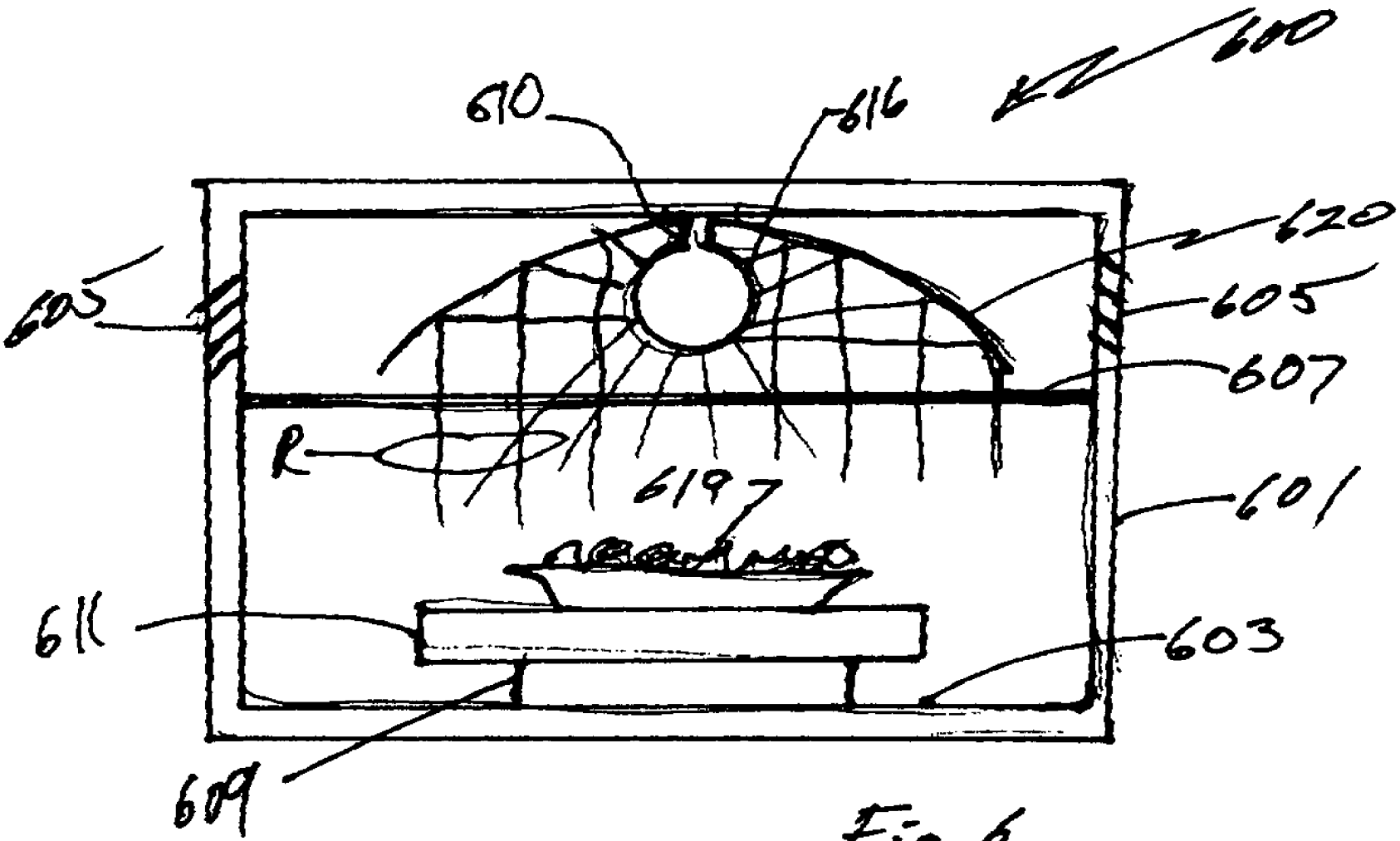
FIG. 6 is a perspective view of the invention used as a food cooker.
Figure 7:
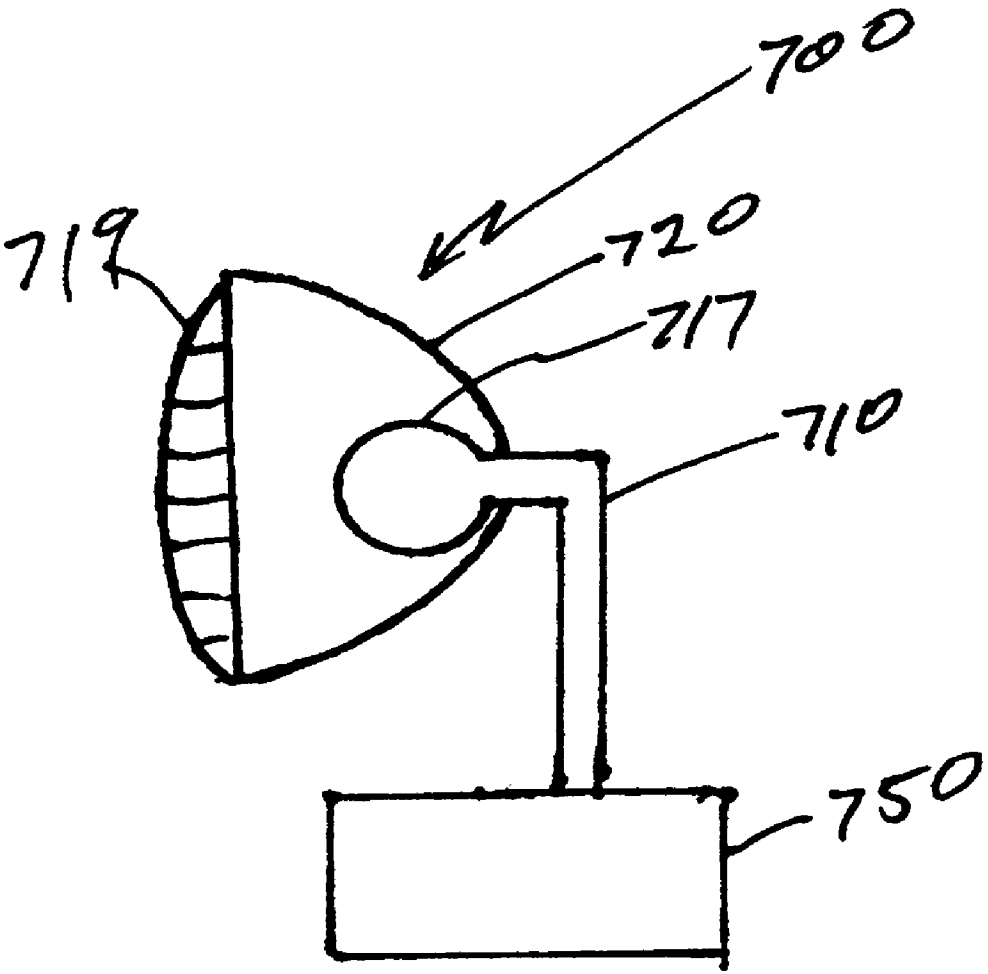
FIG. 7 is a perspective view of the invention used as a space heater.

While the present invention is ideally suited for use in a patio heater configuration, it is also seen as being uniquely suited in other configurations in which highly efficient heat is required along with very low emissions. For instance, the invention could be used as a food cooker, as shown in FIG. 6, or as a space heater, as shown in FIG. 7. Other uses such as wall furnaces and garage heaters are also envisioned, but not shown in the drawings.

In FIG. 6, a cooker unit 600 is shown in its basic form to include an insulated housing 601 having a floor 603, heat vents 605, a cooking platform 609 and rotating plate holder 611. The burner assembly includes the gaseous fuel/air mixture deliver tube 610 that supports the burner 616 and reflector 620. The reflector in this embodiment is curved to redirect the radiation "R" towards the food 619 placed on the plate holder 611, in an even and efficient distribution. An optional splatter shield 607 is shown as being located between the burner 616 and the cooking area in order to prevent grease and food particles from reaching and touching the burner element which may cause back-flashing which is a form of uncontrolled burning. The splatter shield is preferably made of material that is rigid, essentially transparent to heat radiation and easily cleaned. Various glasses are suitable for this purpose. Alternatively, the shield 607 could be a ceramic glass, that re-radiates the heat energy received from the burner 616.

In FIG. 7, a space heater 700 is shown in which a reflector element 720 is oriented to direct heat from the burner 717 to a space selected by the user. In this case, a safety shield 719 is attached to the front of the reflector so as to prevent any foreign contact with the burner element 717. Alternatively, the shield 719 could include an intermediate ceramic glass, which re-radiates the heat energy received from the burner 717. A gaseous fuel/air mixture delivery tube 710 is shown as providing the fuel from the base supply 750 and providing support for the reflector and burner assembly.

The fuel used in the present invention is preferably natural gas or propane. However, it is contemplated that other fuels can also be used, provided they meet the criteria for delivery to the burner in a gaseous state at low pressure on the order of 1-2 atmospheres.

Figure 8:
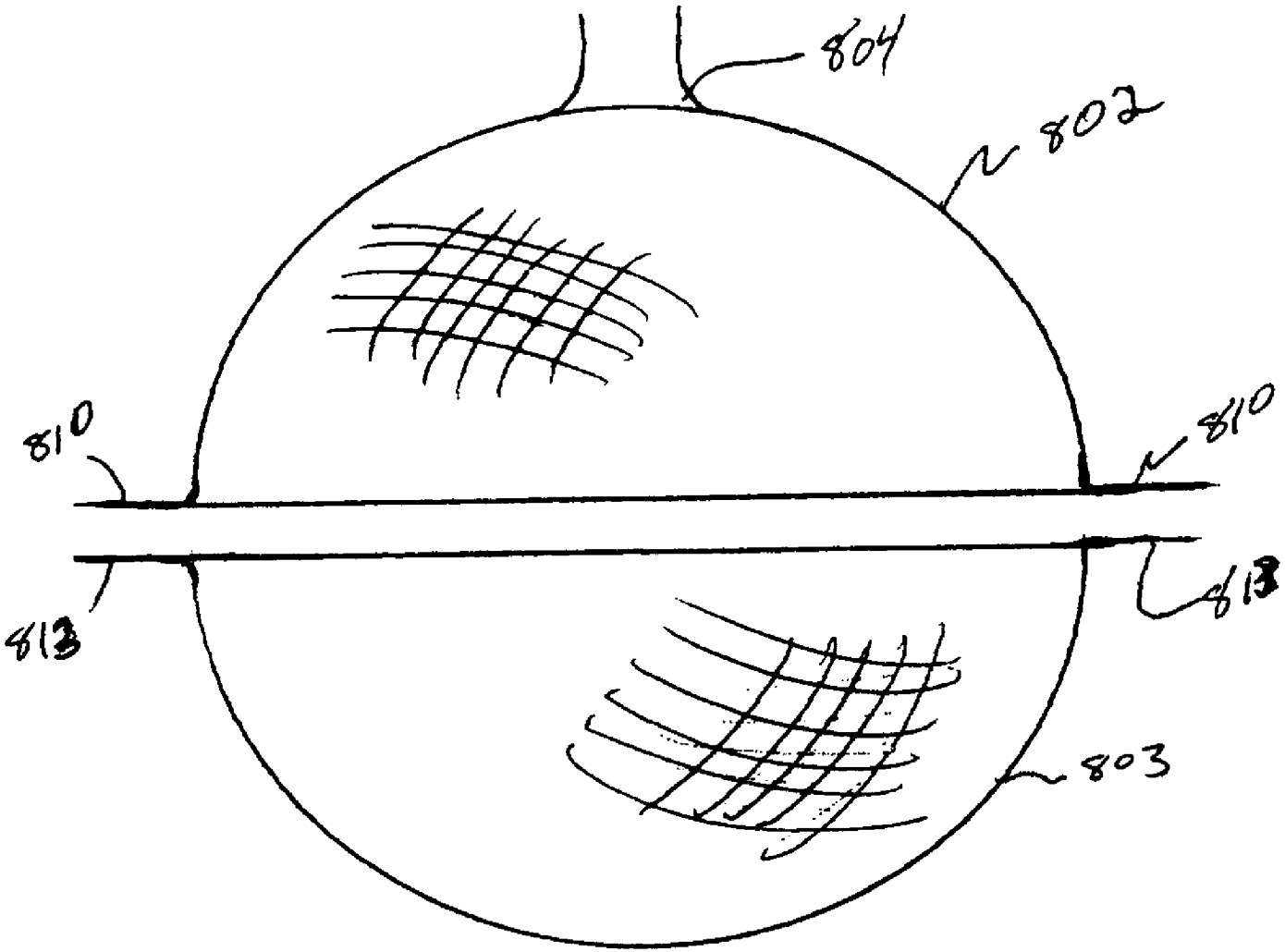
FIG. 8 is a conceptual view of the burner element during an assembly step.
Figure 9:
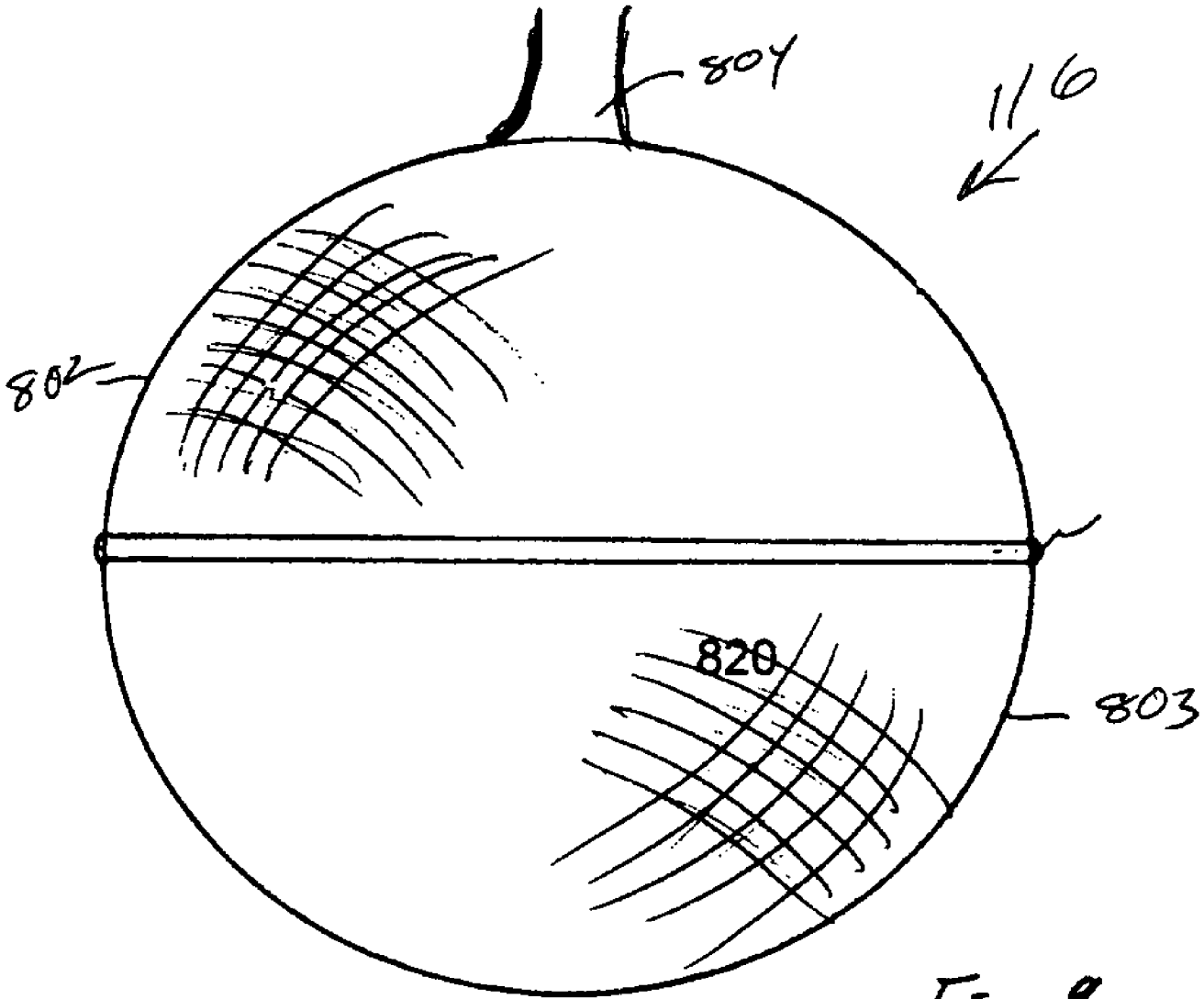
FIG. 9 is a plan view of the burner element after it has been assembled.

The preferred method of forming the spherical shape of the burner element 116, shown in FIG. 1, is to prepare two hemispheres 802 and 803 having the equal diameters, as shown in FIG. 8. In preparing the hemispheres, the mesh is placed over a die and compressed into shape. The result is that a flange 810 and 813 of material is formed around the respective open diameter of each hemisphere. The flanges 810 and 813 can then be clamped together and the flange is welded. The resulting sphere 116 is shown in FIG. 9 with a weld 820 around its equator, following trimming of the excess flange material.

Figure 10B:
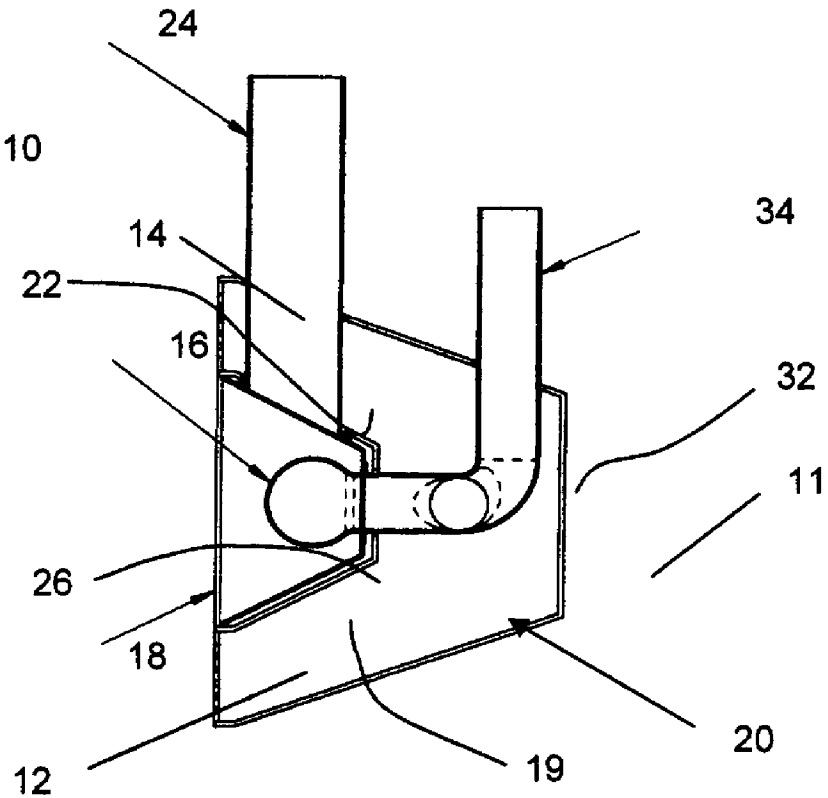
FIGS. 10A and 10B are respective front and side elevation views of a room heater embodiment of the present invention.
Figure 10A:
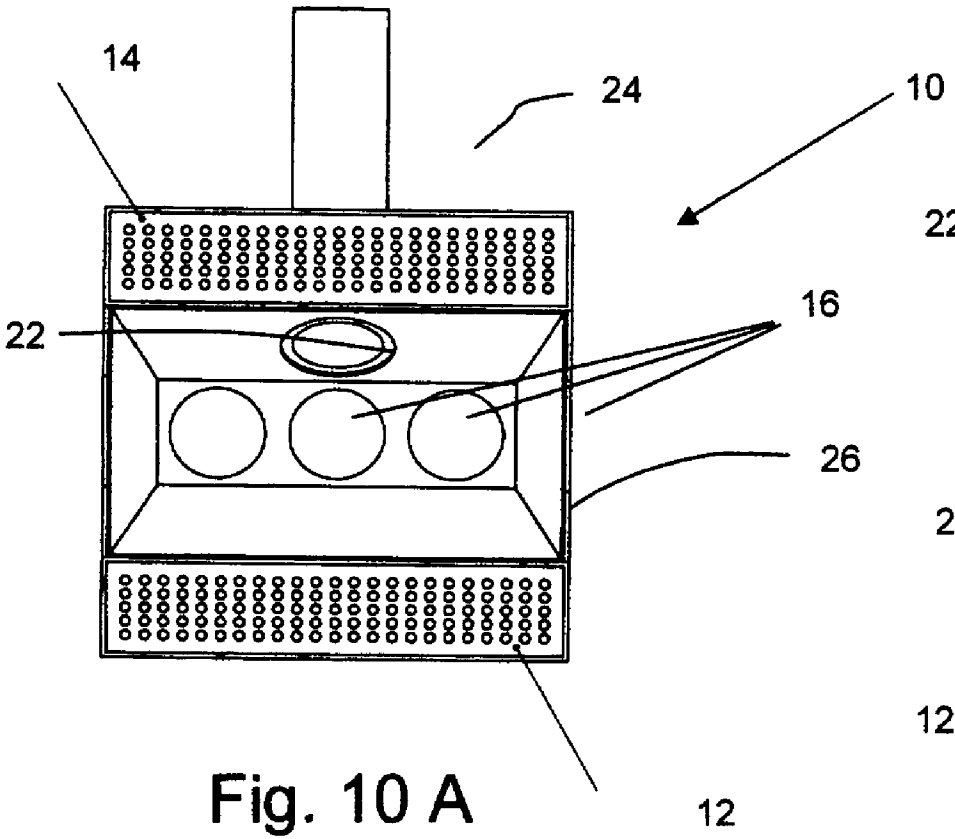

A room heater embodiment 10 is shown in FIGS. 10A and 10B. In this embodiment, a housing 11 is formed of a rigid material such as sheet metal and may be coated with a fire resistant insulation layer, not shown. Three radiant burners 16 of the present invention are shown disposed in a linear array. Depending on the room size and heating capacity of the unit, the burners may be scaled in size and more or fewer radiant burners may be employed.

Due to the extremely low emissions produced by the radiant burners of the present invention, it is understood that the heater 10 of this embodiment could be used as a "ventless" heater without utilizing outside combustion air. However, in this instance the use of outside combustion air and outside exhaust is shown in a conventional way.

The radiant burners 16 are mounted on a reflector support element 19 and are connected to a combustion air inlet duct 34. A horizontal manifold duct 32 is also shown to provide distribution of combustion air to the burners 16. The radiant burners 16 extend into a volume defined by a reflector 26 and a ceramic glass 18. An opening 22 in the reflector 26 and the reflector support 19 allow the combustion gas to be exhausted through vent duct 24.

The housing 11 defines a plenum space 20 that becomes heated by the combustion gases and the heat that migrates from the reflector area. A room inlet vent 12 is provided at the bottom front of the housing 11 and a corresponding room outlet vent 14 is provided at the top front of the housing 11. In this manner convection heat is produced by the heater 10 and dispersed to the room. A fan (not shown) also may be incorporated within the plenum space 20 to increase the air flow and distribution of the convection heat.

The majority of the heat energy produced by the heater 10 is in the form of radiant heat that is projected by the burners 16 and the associated reflector 26 directly into the room. The ceramic glass 18 functions to allow a high percentage of the radiant heat to be transmitted into the room and to separate the radiant burners 16 from coming into contact with foreign objects. Alternatively, radiant heat emanated from the burner(s) 16 and the associated reflector 26 will transfer to the ceramic glass 18 (designed for this purpose). The glass 18 will then radiate the heat to the room.

Although not shown in FIGS. 10A and 10B, the heater embodiment includes the appropriate sensors and systems for ignition control, thermostatic control and high temperature safety cutoff control.

A further alternative to the spherical burner assembly is foreseen as a right cylinder which has its central axis aligned with the vertical. In this manner, the gravitational effects on the cylindrically configured burner assembly will be minimized, while maintaining many of the efficiencies of the other embodiments.

Figure 11:
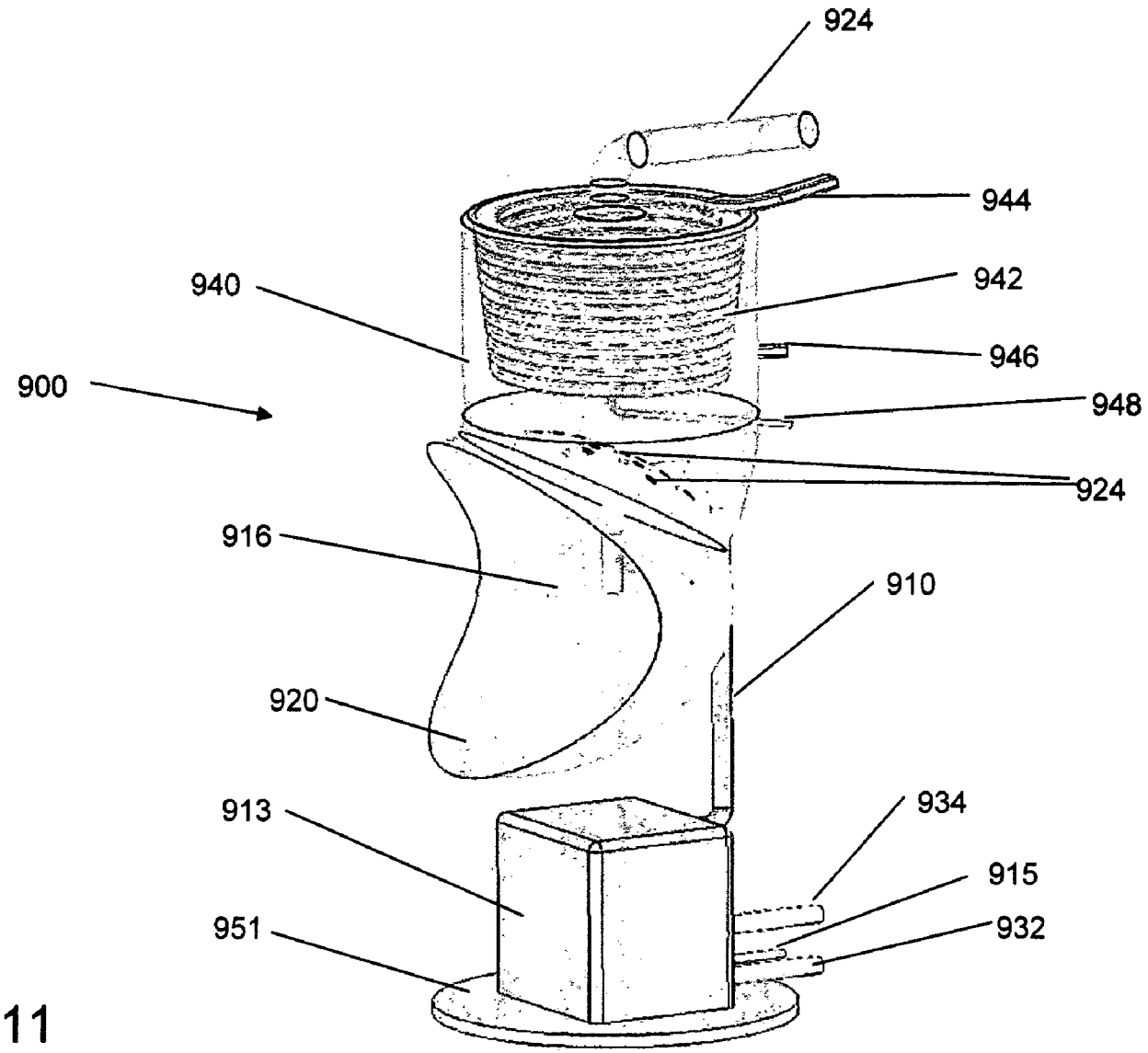
FIG. 11 is a perspective view of the inner portion of another room heater embodiment of the invention.
Figure 12:
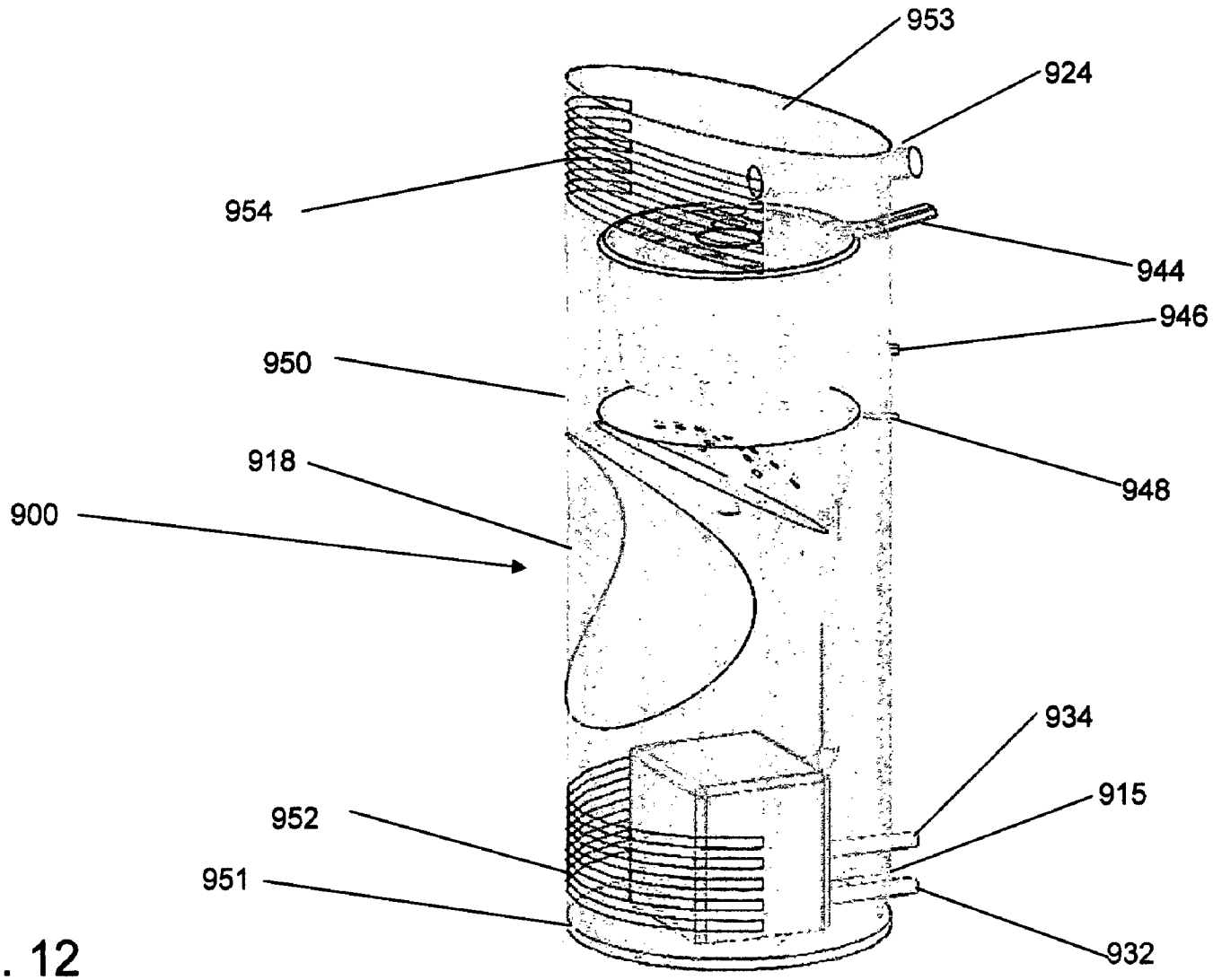
FIG. 12 is a perspective view of the housing for the embodiment shown in FIG. 11.

Another embodiment of the invention is shown in FIGS. 11 and 12 as a heater 900 with a high efficiency heat exchanger 940. In this embodiment, heat exchanger 940 is employed to draw additional heat from the exhaust gas resulting from the controlled combustion in the burner 916. The embodiment includes a base 951 that serves to support the other components of the assembly. A component housing 913 is shown which contains the electronic control unit, valves for controlling the air fuel mixture from the gas supply inlet 932 and the air inlet 934, as well as a fan (not shown) if the mixture requires pressure to the burner 916. Electrical wiring to the main supply is provided at 915. It should be noted that the external air supply 934 may be eliminated if the unit is intended to burn ambient air or if the vaporized fuel is premixed with air prior to being furnished to the unit.

A feed tube 910 extends from the component box 913 to the radiant burner 916, as disclosed above with respect to other embodiments. The feed tube 910 also mechanically supports the reflector 920 and the heat exchanger 940.

In this embodiment the reflector is used to radiate heat from the burner 916 in a predetermined pattern away from the assembly. Combustion gases pass through apertures 924 formed in the top portion of the reflector 920 into the heat exchanger 940. The combustion gas rises through the components of the heat exchanger 940 and is exhausted through exhaust pipe 924.

The heat exchanger 940 is comprised of a helical tubing 942 that is structured to allow laminar flow of the exhaust gas between the individual coils segments where heat is transferred from the gas to the tubing 942. Water or other similar heat transfer media enters through tube extension 946, is passed through the tubing 942 and exits through tube extension 944.

Figure 13:
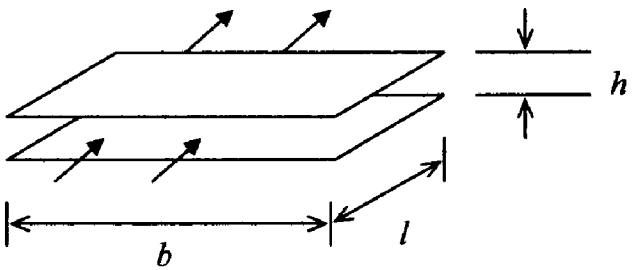
FIG. 13 is a diagram used as a reference for calculating heat transfer efficiencies.

The heat exchanger coil 942 has gaps created by the helical shape of the tubing 942 that are very narrow "h" (about 0.8 mm) and comparably long "l"(shown if FIG. 13). The gaps provide a laminar flow path for the exhaust gas. This results in a very efficient heat exchange process. The exhaust gas enters the heat exchanger 940 at about 900° C. and exits at less than 100° C. Water, or other heat absorbing liquid medium, flows through the tubing 942 and extracts the heat energy from the heated tubing 942. The heated water can be used for various purposes, such as the bathroom or kitchen, or simply as an addition to the home water heater, or for heating other rooms. Because the laminar flow heat exchanger 940 acts as a condenser, condensate water is produced on the outside of the tubing 942 as a by-product of the heat exchange process and is collected at the base of the heat exchanger. The condensate water is drained at tube extension 948. This water has no impurities and may be consumed (assuming it does not pick up impurities from the collection vessel).

The outer housing 950 for the embodiment described with respect to FIG. 11 is shown in FIG. 12. The housing 950 includes a cylindrical tube that mates with the base 951 and has a top panel 953 to form an enclosed space in which the components described with respect to FIG. 11 are contained.

A ceramic glass element 918 is attached to a corresponding aperture in the housing 950 in registration with the reflector 920 in order to allow heat radiation to be directed outward from the unit. The diameter of the cylindrical tube exceeds the diameter of the heat exchanger 940 so as to define a heating space that allows heat which radiates from the back side of the reflector 920 to rise in the housing. Grill like apertures 952 and 954 are formed in the respective lower and upper portions of the housing 950 to allow convection heat to flow out of the unit into the room in which the unit is located. Of course, a fan may be employed within the housing in order to increase the air flow and decrease the housing temperature, if desired.

The heat transfer from exhaust gas to water can be significantly intensified by using the laminar flow of the exhaust gas. The theory is shown below:

LAMINAR FLOW BETWEEN PLATES

HEAT TRANSFER:

$$Nu = 7.55 + \frac{0.024 \cdot \left(Re \cdot Pr \cdot \frac{d_h}{l}\right)^{1.14}}{1 + 0.358 \cdot \left(Re \cdot Pr \cdot \frac{d_h}{l}\right)^{0.64} \cdot Pr^{0.17}}$$

$d_h$: Hydraulic Diameter
Re: Renolds Number
Nu: Nusselt Number
Pr: Pandtl Number
APPROXIMATION:

$$d_h = \frac{4 \cdot b \cdot h}{2b} = 2h$$

$$Nu \approx 7.55 = \frac{\alpha \cdot d_h}{\lambda} \Leftrightarrow \alpha = \frac{7.55 \cdot \lambda}{2 \cdot h}$$

α: Heat Transfer Coefficient
λ: Conduction
PRESSURE LOSS:

$$\Delta p = \frac{96}{Re} \cdot \frac{l}{d_h} \cdot \frac{\rho}{2} \cdot w^2,\ Re = \frac{p \cdot w \cdot d_h}{\eta},\ w = \frac{dm}{h \cdot b \cdot \rho}$$

SUBSTITUTION $$\Delta p = 12 \cdot \frac{\eta}{\rho} \cdot \frac{l}{h^3 \cdot b} dm$$

η: Dynamic Viscosity
ρ: Density — b = width
dm: Mass Flow — h = height
w: Velocity $$1.\ Q = \alpha \cdot F \propto \frac{b \cdot l}{h}$$

$$2.\ \Delta p \propto \frac{l}{h^3 \cdot b}$$

$$2 \rightarrow 1:\ Q \propto \frac{b}{h} \cdot \Delta p \cdot h^3 \cdot b = b^2 \cdot h^2 \cdot \Delta p$$

Q and Δp are given: b · h = Constant

As can be seen from the above theory and with reference to FIG. 13, for a given heat Q to be transferred at a given pressure loss Δp:

1. The necessary area F=b*l=Constant/b of the plates (gives size and mass of the heat exchanger) is indirectly proportional to the width of the gap b. As wider the width dimension b, as smaller is the area F of the heat transfer surface and as lighter the heat exchanger.
2. Since the necessary length l is indirectly proportional to $b^2$, the length l can be kept very short when the dimension of width b is increased.

Figure 14:
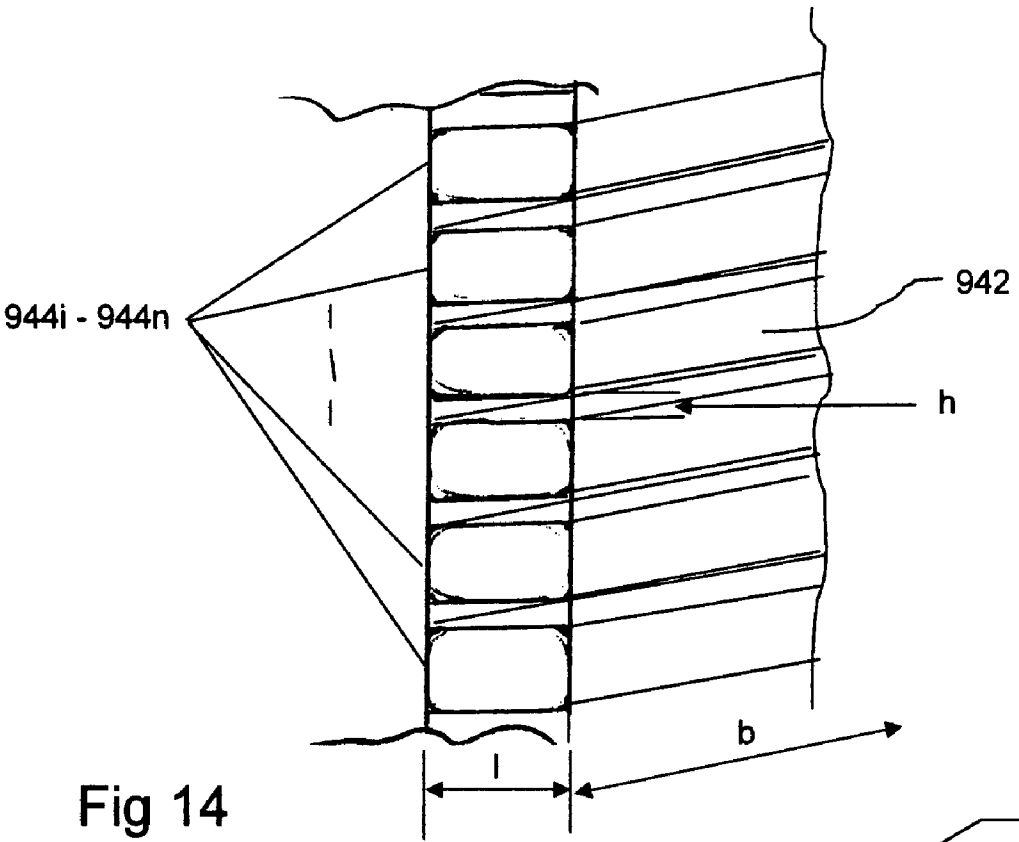
FIG. 14 is a cross-sectional view of a portion of the heat exchanger coil as may be employed in the embodiment shown in FIGS. 11 and 12.

That means for the design of heat exchanger 942, as shown in enlarged cross-section in FIG. 14:

1. The dimension of height h should be as small as possible and should be sufficient to allow laminar flow of the exhaust gas. The height h should be <1 mm (for practical reasons, it cannot be much smaller).
2. The dimension of width b should be as great as possible.

These geometric goals can be achieved with a helical tube 942 by providing rectangular a cross-section indicated by stacked sections **944*i*-944*n*** having the length l, separated by a gap of height h and an extremely long width dimension b running the length of the helical tube.

The laminar flow heat exchanger works very effectively as a condenser. The exhaust gas enters the narrow gap at a temperature of >900° C. and is cooled to less than 100° C. With methane as fuel, a theoretical additional 11% heat can be generated by condensing the water content in the exhaust gas. The condensate forming on the outside of tube 942 from the natural gas combustion is very clean, if the condenser is fabricated from metal that does not contain heavy metals.

Alternatively, an exhaust fan can be provided down stream from the heat exchanger to make sure that the cooled combustion is exhausted from the unit. Heat control from the unit can be provided by several means. A first method of control is to regulate the fuel flow to the burner with an adjustable thermostat feedback. A second method is by including several choices of ceramic glass windows having varying transmission characteristics for manual placement on the front of the unit.

Figure 15:
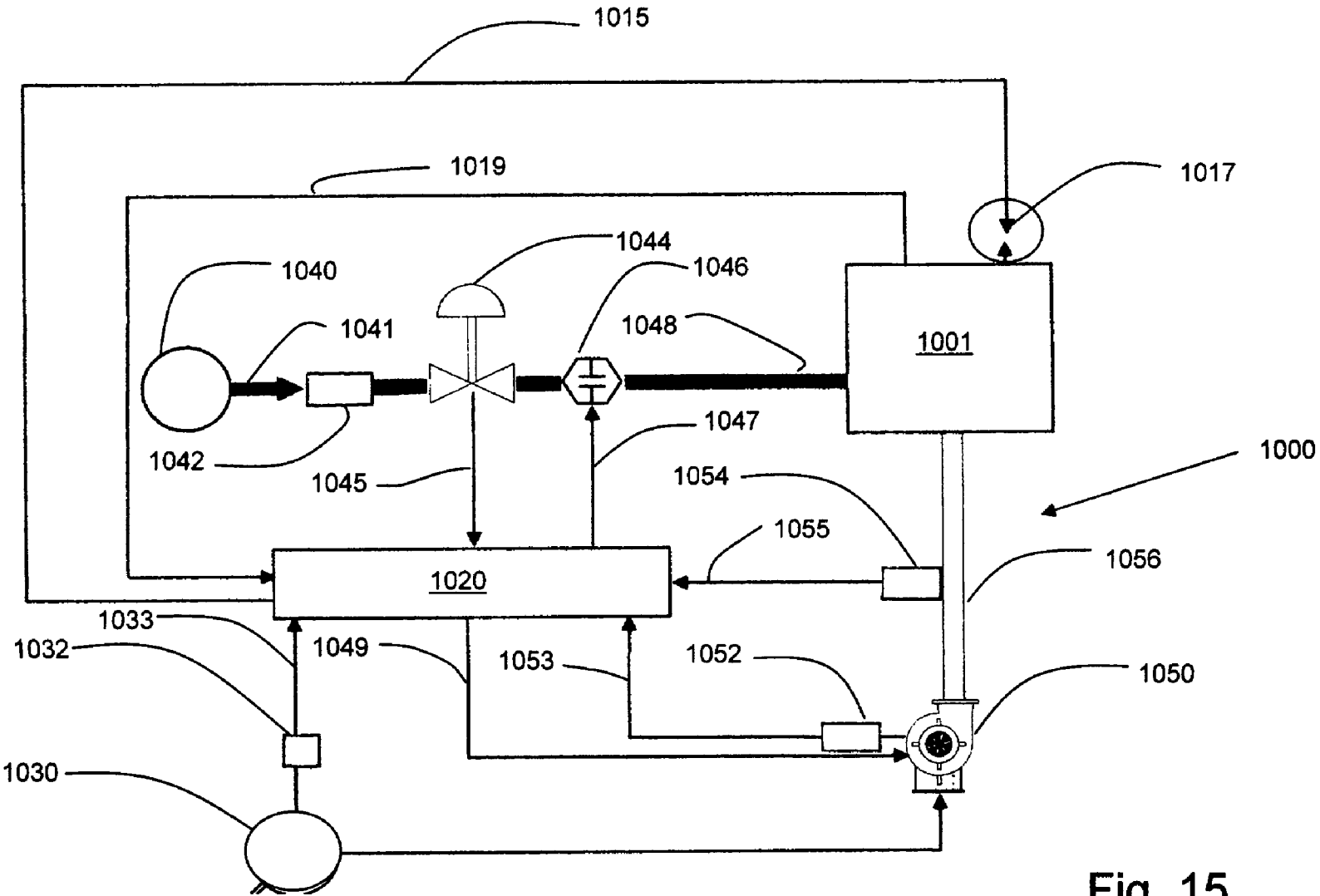
FIG. 15 is a block diagram of a control system for use in a patio heater embodiment.

FIG. 15 shows a block diagram of a control system 1000 as may be employed for the radiant burner of the various embodiments described herein. The radiant burner is represented as block 1010 which receives regulated fuel vapor input from gas line 1048 and controlled air from air tube 1056. The fuel is derived from source 1040, which may be natural gas, methane, propane, butane, diesel or other bio or petro products which can be provided in a vapor state. The fuel passes through a tube 1041 to a pressure regulator 1042 of a conventional type and a manually adjustable valve 1044. An electrically controlled gas shut-off valve 1046 may also be used for added safety. Following the gas shut-off valve 1046, the fuel is piped to the radiant burner 1010 where it is mixed with air for controlled combustion. Electrical power for system is supplied from a source 1030 through a manually activated switch 1032.

An electronic controller 1020 receives power from source 1030 and switch 1032 on line 1033. After sensing on line 1045 that the gas valve 1044 is turned on, electronic controller 1020 provides initial ignition to the burner 1010 through line 1015 to spark igniter/flame sensor 1017. The controller then monitors the existence of a flame via the flame sensor 1017 on line 1019. And regulates the air flow into the burner by controlling the speed of the blower 1050 on line 1049. The air flow control is performed in response to the manual setting of gas valve 1044 to maintain the fuel/air mixture at the desired level that provides substantially complete combustion on the surface of the burner. Other safety devices in the controller 1000 include an air flow sensor 1052 and a tip-over sensor 1054. When either of these sensors are tripped, for the lack of air flow in the case of sensor 1052 or tip over of the unit in the case of sensor 1054, the electrical controller deactivates the gas shut-off valve 1046 to cause the burner to be turned off.

It should be understood that the foregoing description of the embodiments is merely illustrative of many possible implementations of the present invention and is not intended to be exhaustive.

We claim:

1. A radiant burner assembly comprising:

a generally spherical shaped burner element;

a fuel/air delivery tube having an end opening to allow for a fuel/air mixture to be delivered within said spherical burner element;

said burner element has a first opening that surrounds said end opening of said fuel/air delivery tube;

said burner element is formed with inner and outer spherical surfaces and an array of apertures of a predetermined size and spacing over substantially the entire inner and outer spherical surfaces of said burner element and formed of a material that remains undeformed at all temperatures within the range of use;

a generally spherical shaped diffuser element of a smaller diameter than said burner element, having a second opening that surrounds said end opening of said fuel/air delivery tube;

said diffuser element is formed of sheet material with inner and outer spherical surfaces with an array of apertures of a predetermined size and spacing over substantially the entire inner and outer spherical surfaces of said diffuser element;

said diffuser element being mounted concentrically within said burner element to provide a generally equally spaced distance between said inner surface of said burner element and said outer surface of said diffuser element and remaining undeformed at all temperatures within the range of use; and a distributor element mounted between said fuel/air delivery tube end opening and said diffuser element to direct said fuel/air mixture generally uniformly towards the inner surface of said diffuser element.

2. A burner assembly as in claim 1, wherein said distributor element is formed as a circular disk that causes said air/fuel mixture from said opening to be distributed in radial directions.

3. A burner assembly as in claim 2, mounted adjacent a reflector element to distribute radiated heat from said burner assembly in a predetermined distribution pattern about a generally vertical axis, wherein said delivery tube is oriented to deliver the fuel/air mixture through said end opening in a direction along said generally vertical axis, said burner element, said diffuser element and said distributor element are each attached to said fuel/air delivery tube and extend outward of said end opening of said fuel/air delivery tube and said reflector element.

4. A burner assembly as in claim 1, mounted adjacent a reflector element to distribute radiated heat from said burner assembly in a predetermined distribution pattern about a generally vertical axis, wherein said fuel/air delivery tube is oriented to deliver the fuel/air mixture through said end opening in a downward direction along said generally vertical axis, said burner element is attached to said fuel/air delivery tube and extends below said end opening of said fuel/air delivery tube and said reflector element.

5. A radiant burner assembly as in claim 1, further comprising a reflector element configured to surround at least one hemisphere of the burner element and formed to control the distribution of heat from said burner element in a predetermined pattern.

6. A radiant burner assembly as in claim 5, wherein said assembly is the radiant heat energy source of a patio heater and said heater includes a base unit which houses a fuel source, and supports said air/fuel delivery tube which connects between said fuel source and said burner assembly for delivering fuel to said assembly.

7. A radiant burner assembly as in claim 6, wherein said heater base unit includes a fan for forcing air onto said supported air/fuel delivery tube for delivering air to said burner assembly and said heater further includes a control system for controlling the amount of air delivered by said fan to said burner assembly according to predetermined factors to maintain combustion at said burner surface to a predetermined range of temperatures below 1600° C.

8. A radiant burner assembly as in claim 7, wherein said heater includes a manually controlled valve for adjusting the fuel flow from said fuel source to said burner assembly.

9. A radiant burner assembly as in claim 5, wherein said assembly is the radiant heat energy source of a cooker which includes a housing for confining said radiated heat to accomplish the heating of food on a platform below said reflector and burner element, with a protective shield disposed between said food or the like and said burner to prevent back-flashing.

10. A radiant burner assembly as in claim 5, wherein said assembly is the radiant heat energy source of a portable room heater which includes a housing with an opening to allow said heat to be radiated in a predetermined distribution pattern.

11. A radiant burner assembly as in claim 5, wherein said assembly is the radiant heat energy source of a room heater which includes a housing with an opening to allow said heat to be radiated in a predetermined distribution pattern and said heater includes a heat exchanger element configured to be in the path of combustion gas exhausted from said burner element and to extract additional heat from the assembly.

12. A radiant burner assembly as in claim 11, wherein said heat exchanger is disposed in said housing so as to provide convection heat to air flowing over said heat exchanger and ducted to supply additional heat to a room.

13. A radiant burner as in claim 1, wherein said burner material is a woven mesh of high temperature steel with apertures below 0.8 mm.

14. A radiant burner assembly as in claim 1, wherein said burner material is a perforated steel metal stamping having apertures below 0.8 mm in diameter and evenly spaced by approximately 0.4 mm.

15. A radiant burner assembly as in claim 1, wherein said burner element contains a catalyst coating and said apertures are maintained at no more than 0.8 mm in diameter.

16. A radiant burner assembly as in claim 1, wherein said fuel/air mixture is distributed over said inner surface of said burner element and combustion is confined to said inner surface of said burner element when temperature reaches a predetermined level below 1600° C. to maintain direct radiation of heat from said burner element.

17. A radiant burner assembly as in claim 16, wherein said combustion is maintained as a non-visible flame.

18. A radiant burner assembly as in claim 1, wherein said fuel/air mixture is in the form of a micro-mist fuel injected into the air flow entering the burner assembly through the fuel/air delivery tube.

19. A radiant burner assembly as in claim 18, wherein said micro-mist fuel is produced by providing liquid fuel under pressure to a heated capillary tube where said fuel is heated to a temperature approximately equal to the boiling point of the fuel and then injected from the open end of the capillary tube into said burner assembly.

20. A radiant burner assembly comprising:

a generally spherical shaped burner element having a first opening that surrounds the open end of a fuel/air delivery tube, wherein said burner element is formed of high temperature metal that has an array of apertures of a predetermined size and spacing over the entire spherical inner and outer surfaces of said burner element;

a generally spherical shaped diffuser element of a smaller diameter than said burner element having inner and outer surfaces and mounted concentric therewith to be equally spaced from said inner surface of said burner element and mounted to surround said open end of said fuel/air delivery tube;

a distributor element mounted between said open end of said fuel/air delivery tube and said diffuser element to direct said fuel/air mixture generally uniformly towards said inner surface of said diffuser element;

a reflector element substantially surrounding said burner element to direct said radiation in a predetermined distribution pattern and providing at least one opening to allow the escape of combustion gas; and a heat exchanger element configured to be in the path of combustion gas exhausted from said burner element so as to extract additional heat from the assembly.

21. A radiant burner assembly comprising:

a generally spherical shaped burner element having a first opening that is attached to a fuel/air delivery tube having an open end for providing an air/fuel mixture into the interior of said burner element, wherein said burner element is formed of high temperature metal that has an array of apertures of a predetermined size and spacing over the entire spherical inner and outer surfaces;

a generally spherical shaped diffuser element of a smaller diameter than said burner element;

said diffuser element having inner and outer surfaces and being attached to said fuel delivery tube to be concentric with said burner element and to have said outer surface of said diffuser element spaced from said inner surface of said burner element and to surround said open end of said fuel/air delivery tube; and a distributor element mounted between said open end of said fuel/air delivery tube and said diffuser element to direct said fuel/air mixture generally uniformly towards said inner surface of said diffuser element.

* * * * *